United States Patent [19]

Rackard

[11] 4,027,431

[45] June 7, 1977

[54] SINGLE HUNG WINDOW WITH REMOVABLE FIXED LITE

[75] Inventor: Troy D. Rackard, Lexington, N.C.

[73] Assignee: National Gypsum Company, Buffalo, N.Y.

[22] Filed: Nov. 10, 1975

[21] Appl. No.: 630,739

[52] U.S. Cl. ..... 49/458

[51] Int. Cl.[2] ..... E05D 15/16

[58] Field of Search ..... 49/404, 406, 445, 446, 49/453, 458, 463, 464, 465, 466

[56] References Cited

UNITED STATES PATENTS

| | | | |
|---|---|---|---|
| 2,727,596 | 12/1955 | Smith | 49/463 |
| 2,799,890 | 7/1957 | Stavich | 49/463 |
| 2,818,919 | 1/1958 | Sylvan | 49/453 |
| 2,952,048 | 9/1960 | Graham | 49/446 |
| 3,455,060 | 7/1969 | Fournier | 49/445 |
| 3,466,806 | 9/1969 | Teggelaar et al. | 49/445 |
| 3,584,417 | 6/1971 | Gatton | 49/404 |

*Primary Examiner*—Peter M. Caun
*Attorney, Agent, or Firm*—Robert F. Hause

[57] ABSTRACT

A two lite single hung window with a top fixed lite having a structure permitting affixation within the window frame involving only two screws, providing a window frame opening free of any middle rail when both lites are removed from the frame.

10 Claims, 5 Drawing Figures

SINGLE HUNG WINDOW WITH REMOVABLE FIXED LITE

This invention relates to a two lite single hung window including a lower lite which may be raised and lowered and also removed, and secondly an upper lite which is fixed in the window above and outward of the lower lite, which upper lite is readily removed by removal of one screw from each side of the upper lite.

Prior single hung windows with a removable upper lite involved elongate extruded aluminum stops which were driven into the frame, around the periphery of the fixed upper lite. When extruded strips were removed, the fixed lite could be removed for cleaning or any other purpose, however a horizontal middle rail remained in place.

It is an object of the present invention to provide a single hung window with a fixed lite construction adapted for improved simplified removal.

It is a further object of the invention to provide an upper fixed mounting which is firm and well sealed and removable by removal of only two screws.

It is a still further object of the invention to provide for a simplified removal of an upper fixed lite without leaving a horizontal middle rail remaining in the window frame.

These and other objects and advantages of the invention will be more readily apparent when considered in relation to the preferred embodiment as set forth in the specification and shown in the drawings in which.

Figure 1:
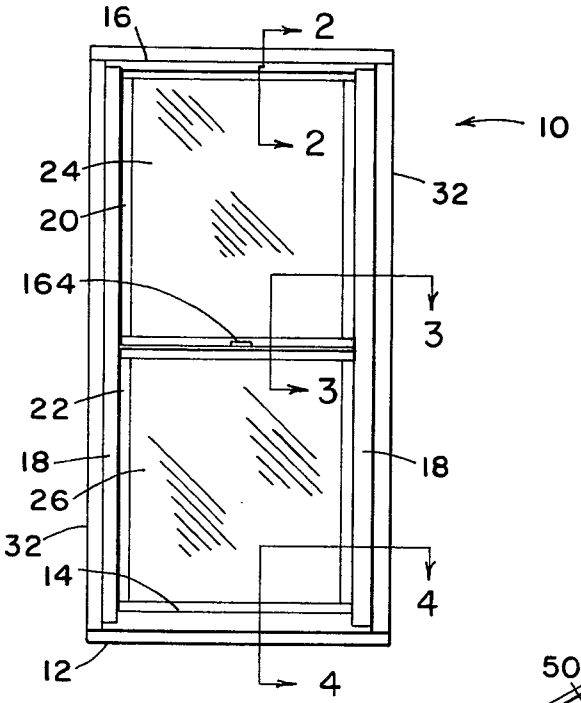
FIG. 1 is a front elevational view of a window made in accordance with the invention.

Referring to FIG. 1, there is shown a window 10, suitable for mounting in an opening in a building wall. The window 10 includes a frame 12 including a horizontal sill member 14, a horizontal head member 16, and a pair of vertical jamb members 18, 18. The frame 12 forms an opening therewithin in which there are disposed a upper fixed sash 20 and a lower vertically slidable sash 22.

Each sash 20, 22 has a sheet of glass 24, 26 mounted in suitable channels 28 containing glazing vinyl strips 30.

The frame 12 and the sashes 20, 22 are formed of lightweight aluminum extrusions designed to coact when asembled, as herein disclosed, to provide a completed window of improved characteristics.

The frame 12 includes protruding mounting strips 32 extending outwardly about one to two inches in all four directions for engaging the wall of a building around the opening in the wall.

In addition to an upwardy extending mounting strip 32, the headmember 16 includes a main cross member 34 downwardly extending narrow outer flange 36 and inwardly thereof a downwardly extending, elongate interlocking lug 38. Lug 38 has a generally L-shaped, or obtuse-angle shaped, cross-section with the bottom leg 40 extending outward and at least to some degree toward outer flange 36.

Upper sash 20 has a top horizontal member 42. Top horizontal member 42 includes a main web 44, a downwardly opening channel 28, an upwardly extending outer flange 46 and an upwardly extending, inwardly directed interlocking lug 48.

Interlocking lug 48 and flange 46 are formed to fit lockingly between the outer flange 36 and interlocking lug 38 of head member 16, with lug 48 disposed over leg 40 when flange 46 is disposed against flange 36. Interlocking lug 48 has an elongate flexible vinyl weatherstrip 50 affixed along the top surface which engages the underside of cross member 34 of head member 16. The weatherstrip 50, along with the double metal to metal contact between head member 16 and sash top member 42, provides excellent weathering ability.

The above-discussed structure will be seen to permit ready removal of the upper sash and replacement, by tilting the sash so the bottom of the sash is extending inwardly at about 45° angle. When tilted, the outer flange 46 drops downwardly and the lug 48 can be freely moved in and out of its interlocking position over lug 38. When interlocked, the upper sash will be seen to be a fixed sash, which cannot be slid down.

Figure 3:
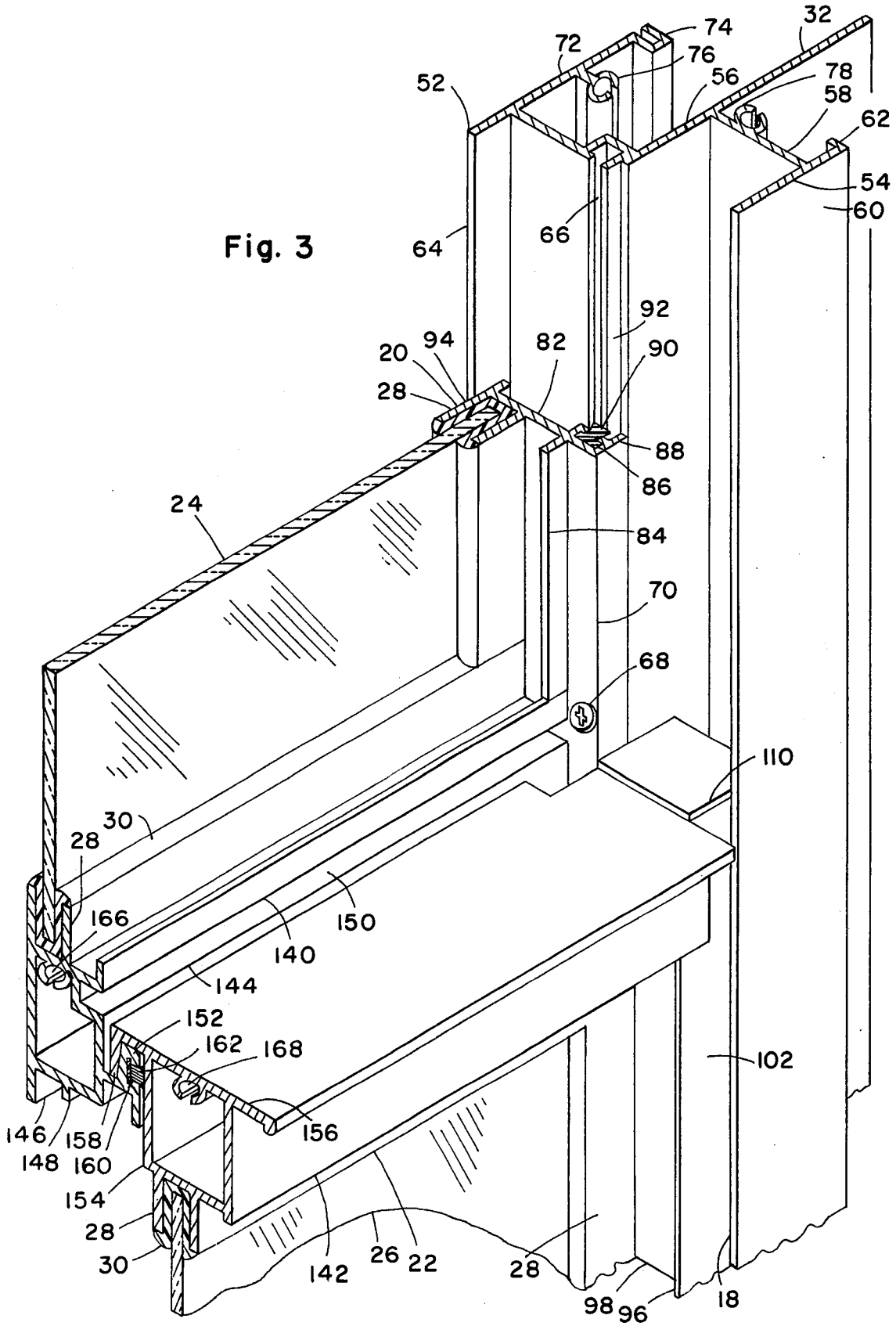
FIG. 3 is an isometric view of the center right porton of the window of FIG. 1 with sections taken along line 3—3 of FIG. 1.

Referring to FIG. 3, the right jamb member 18 will be seen to include, in addition to rightwardly extending mounting strip 32, both an outwardly upper sash receiving portion 52 and an inwardly lower sash receiving portion 54. Inner portion 54 is essentially a channel for retaining the lower sash 22, and includes central wall 56, web 58 and inner wall 60. Inner wall 60 extends rightward of web 58 and terminates with outwardly directed trim flange 62.

Outer portion 52 is formed to receive and retain upper sash 20, as it is inserted, as described above, by being disposed at a 45° angle, interlocked along its top edge and then tilted vertical into position. Outer portion 52 includes an outer flange 64 which limits the outward movement of sash 20 as it is tlted into position, as described above. At the inner edge of outer portion 52, there is a vertically extending screw-receiving slot 66 which opens leftwardly, to receive a screw 68 which extends through the right vertical member 70 of upper sash 20, near the bottom thereof. The screw 68 has threads which engage the sides of screw-receiving slot 66.

Outer portion 52 further includes an outwardly disposed rightwardly extending trim section 72. At the outer end of section 72 is an interlocking channel 74 for interlocking with a complementary element on the left trim section of an adjacent window when it is desired to use double side-by-side windows.

Figure 2:
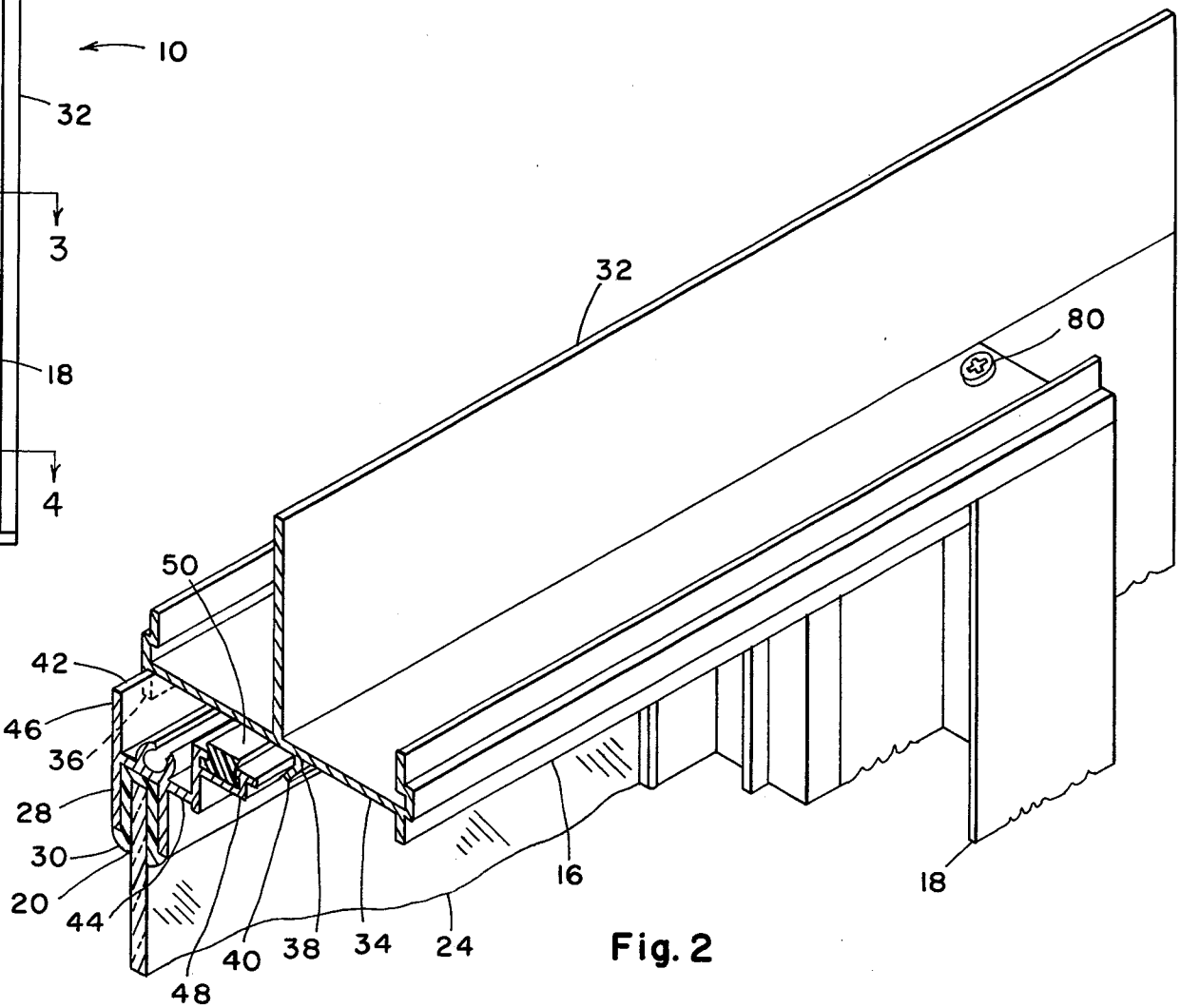
FIG. 2 is an isometric view of a top right corner of the window of FIG. 1 with a section taken along line 2—2 of FIG. 1.

On the inner face of trim section 72 is an elongate screw channel 76. On the right face of web 58 is a screw channel 78. Screw channels 76, 78 provide a means for affixing head member 16 to jamb member 18, and sill member 14 to jamb member 18. Screws 80, such as shown in FIG. 2, extend through a perpendicular section, such as cross member 34, into the end of a respective screw channel, such as screw channel 78, with the threaded shank forming threads therein.

The left vertical jamb member 18, not shown in detail is similar to the right jamb member 18, with the exception of the presence of means to interlock with interlocking channel 74 in place of the channel 74.

The right vertical member 70 of upper sash 20 includes a main web 82, a leftwardly opening channel 28, an inwardly disposed leftwardly directed short trim flange 84, a rightwardly opening channel 86 and an inwardly disposed, rightwardy directed short trim flange 88. Channel 86 has an elongate flexible vinyl weatherstrip 90 affixed therewithin extending rightward to firmly engage right jamb 18. Trim flange 88 is formed to abut an inner surface 92 of right jamb 18 when the outer surface 94 of right vertical member 70 abuts the inner surface of outer flange 64 of right jamb 18. The weatherstrip 90, along with the double metal to metal contact between right jamb member 18 and upper sash right member 70 provides excellent weathering ability. The left vertical member 70 is similar to the right vertical member 70.

The right vertical member 96 of lower sash 22 includes a main web 98, a leftwardly opening channel 28, and rightwardly extending flanges 100 and 102. Flange 100 is the outward of the two flanges and includes a channel 104 which holds a plastic woven pile weatherstrip 106. Weatherstrip 106 is held firmly against central wall 56, and prevents metal to metal contact when lower sash 22 is raised and lowered. Affixed on the inner face of flange 102, near the bottom, is a small low friction rigid plastic button 108 suitable for sliding along the abutting face of inner wall 60 when lower sash 22 is raised and lowered, avoiding metal to metal frictional rubbing.

At the top of right vertical member 96 is a low friction plastic cap 110 which is of a dimension to provide the rubbing action at the top which button 108 provides at the bottom. Immediately under cap 110 is a spring loaded device, not shown, which is a standard means for providing counterbalancing of the lower sash, so that the lower sash will remain raised when desired. This device is preferably a block and tackle type counterbalancing mechanism. The left vertical member 96 is similar to the right vertical member 96. The spring loaded devices in each vertical member 96 permit disengagement of the devices from the other parts of the lower sash 22 when desired, so that the lower sash can be moved enough leftward or rightward to permit one vertical member 96 to move deeper into its respective jamb 18 and the opposite vertical member 96 to move completely out of its respective jamb 18, for removal of sash 22 from frame 12.

Figure 4:
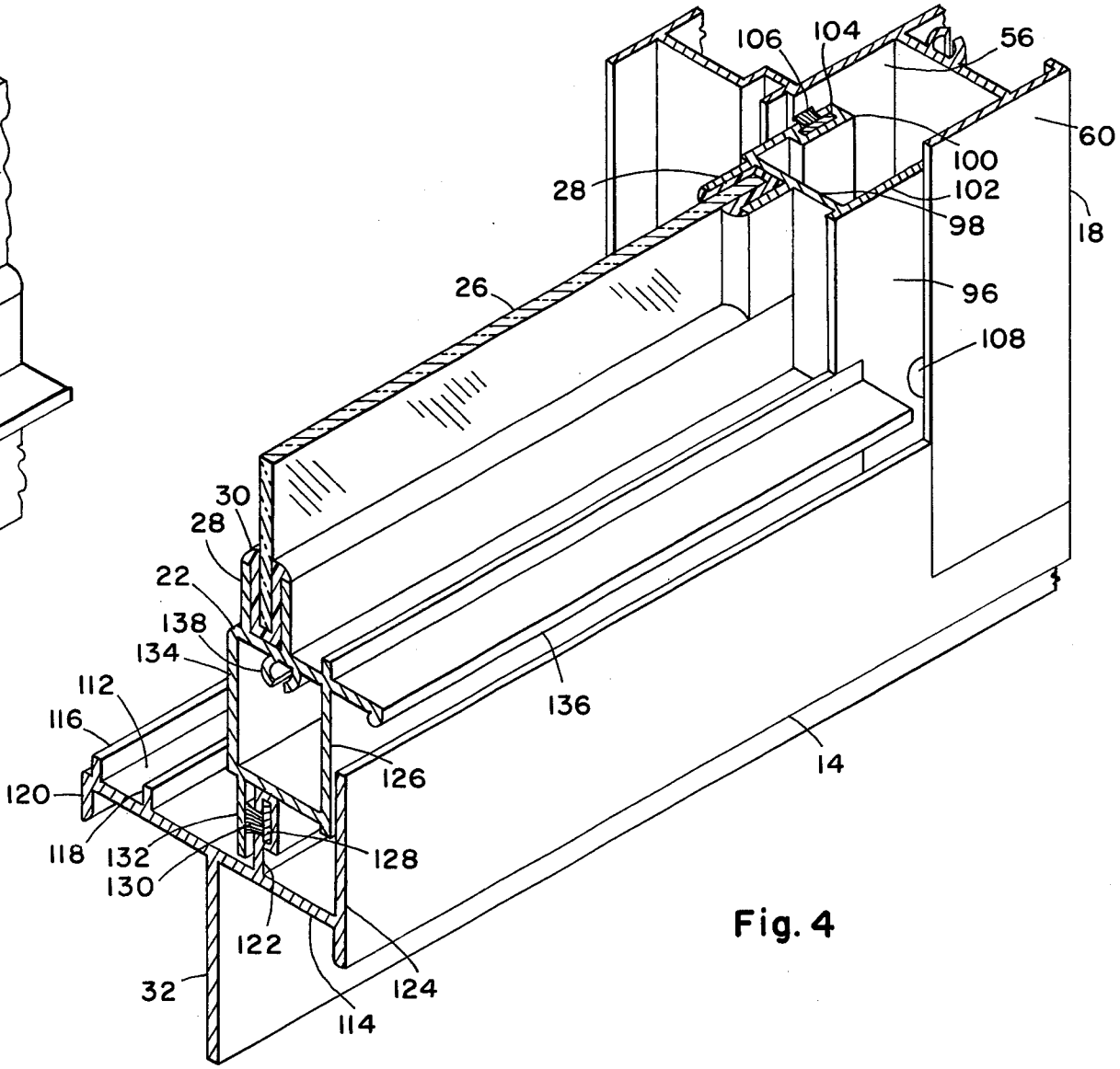
FIG. 4 is an isometric view of the lower right corner of the window of FIG. 1 with sections taken along line 4—4 of FIG. 1.

Referring to FIG. 4, the sill member 14 will be seen to include, in addition to downwardly extending mounting strip 32, both an outwardly window screen receiving portion 112 and an inwardly lower sash receiving portion 114. Outer portion 112 includes two spaced parallel narrow upwardly extending flanges 116 and 118 for receiving the bottom edge of a window screen, not shown, and an outward, downwardly extending narrow trim flange 120. Inner portion 114 includes two upwardly extending flanges 122 and 124 for engaging the bottom horizontal member 126 of lower sash 22. The outer flange 122 includes an outwardly opening channel 128 which holds a plastic woven pile weatherstrip 130. Weatherstrip 130 is held firmly against a downwardly extending flange 132 on the bottom member 126 of lower sash 22, when the lower sash is in its downward closed position, as shown. The top surface of outer flange 122 provides a stop which limits the downward movement of lower sash 22. Inner flange 124 extends upward as a trim member, concealing the bottom edge of bottom member 126, when the lower sash is down. The weathership 130, along with the double metal to metal close adjacency between sill member 14 and sash bottom member 126, provides excellent weathering ability.

The bottom horizontal member 126 of lower sash 22 includes an elongate box section 134, an upwardly opening channel 28, downwardly extending flange 132, discussed above, and an inwardly extending fingertip lift flange 136. Inside box section 134 is an elongate screw channel 138, which provides a means for receiving and holding the threads of screws, in attaching vertical members 96 of lower sash 22 to the bottom horizontal member 126.

Figure 5:
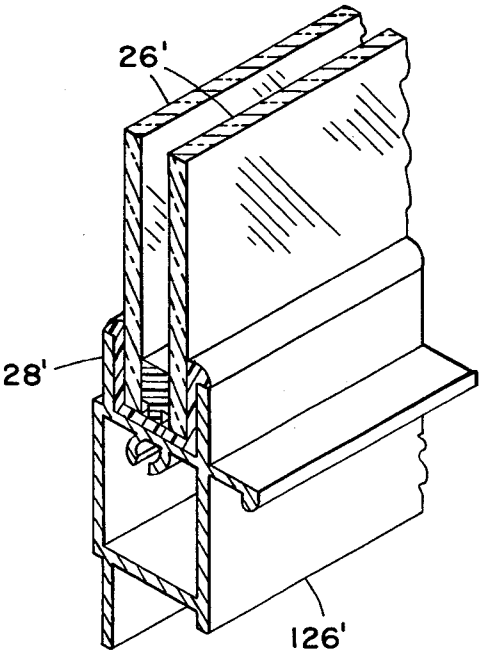
FIG. 5 is an isometric view of a modified form of the lower right corner of the lower lite, wherein a double pane is provided.

A modified form of bottom horizontal member 126' is shown in FIG. 5 with a wider channel 28' for receiving double pane insulating glass 26'.

Referring to FIG. 3, there is shown the inter-engaging upper sash lower horizontal member 140 and the lower sash upper horizontal member 142.

Lower member 140 includes an elongate, hollow, generally box-shaped section 144, an upwardly opening channel 28, a pair of downwardly extending spaced parallel narrow flanges 146 and 148 for receiving the spring loaded clips of the top edge of a window screen, not shown, an inwardly opening lock groove 150 and an inwardly extending and then upwardly and inwardly angled interengaging flange 152.

Upper member 142 includes an elongate, hollow, box-shaped section 154, a downwardly opening channel 28, a wide top shelf 156 atop box section 154, and a downwardly and outwardly angled interengaging flange 158.

The two interengaging flanges 152 and 158 are arranged to make overlapping engagement when lower sash 22 is fully lowered. The angles of flanges 152 and 158 are sufficient to urge the upper sash and lower sash firmly together when the lower sash is fully lowered. The inner face of interengaging flange 152 has a channel 160 which holds a plastic woven pile weatherstrip 162. Weatherstrip 162 is held firmly against box section 154 of the upper member 142 of lower sash 22, when the lower sash is fully lowered. The firmly engaged angled flanges 152 and 158 and the weatherstrip 162 provide excellent weathering ability.

A cam type latch sash lock 164 is mounted atop shelf 156 at the center of the window, FIG. 1, and when turned to lock the window it engages lock groove 150, preventing the raising of lower sash 22.

Box section 144 has an elongate screw channel 166 and box section 154 has an elongate screw channel 168, which screw channels provide means for receiving and holding the threads of screws in attaching vertical members 70 and 96, respectively, to horizontal members 140 and 142.

After removal of lower sash 22 as described further above, the upper sash 20 is removed from frame 12 by the removal of one screw 68 from the bottom of each vertical trim member 70 and the tilting of the bottom of upper sash 20 inward, whereby the upper sash 20 becomes free from engagement with frame 12.

Upon removal of the two sashes 20 and 22, the window frame is free of any middle horizontal rail.

Replacement of the sash is an equally simplified process, reverse of the removal process.

Having completed a detailed disclosure of the preferred embodiments of my invention so that those skilled in the art may practice the same, I contemplate that variations may be made without departing from the essence of the invention or the scope of the appended claims.

I claim:

1. A window comprising a rectangular frame and an upper sash and a lower sash mounted in said frame, said upper sash being mounted above and outwardly of said lower sash, said frame consisting of a horizontal head member, a horizontal sill member, a pair of vertical jamb members and being free of any horizontal member between said head member and said sill member, said lower sash being removably mounted in said pair of vertical jamb members for vertical sliding movement relative to said vertical jamb members, said upper sash being removably mounted on said pair of vertical jamb members and said head member, said upper sash having a top horizontal member, said upper sash top horizontal member and said head member having cooperative interlocking members adapted to vertically hold said upper sash against said head member when said upper sash is vertically mounted in said frame and adapted to permit relative vertical movement of said upper sash when said upper sash is tilted by moving the bottom of said upper sash inwardly, a fastener disposed at the lower portion of each vertical member of said upper sash connecting and holding said lower portion of each vertical member in fixed position relative to the respective adjacent vertical jamb member, said fastener being adapted for readily disconnecting of said lower portion of each vertical member from said respective vertical jamb member, and cooperative means on the lower horizontal member of said upper sash and on the upper horizontal member of said lower sash for sealing the juncture of said sashes when said slidable lower sash is fully lowered.

2. The window of claim 1 wherein said vertical jamb members have an elongate groove with an opening directed toward said upper sash and wherein said fasteners are removably engaged in said elongate groove.

3. The window of claim 2 wherein said fasteners are screws.

4. The window of claim 1 wherein said upper sash top horizontal member has an inwardly directed lug and said head member has a corresponding cooperative outwardly directed lug adapted to fit under said inwardly directed lug when said upper sash is inserted into said frame.

5. The window of claim 1 wherein said frame and said sashes are formed of elongate metal extrusions.

6. The window of claim 4 wherein said frame and said sashes are formed of elongate metal extrusions, and said cooperative lugs are elongate metal flanges.

7. The window of claim 5 wherein all junctions of sash to frame and sash to sash include a combination of metal-to-metal seal and flexible weatherstrip-to-metal seal.

8. The window of claim 1 wherein said cooperative means on the lower horizontal member of said upper sash and on the upper horizontal member of said lower sash for sealing the juncture consists of an inwardly and upwardly directed flange on said upper sash and an outwardly and downwardly directed flange on said lower sash, which said two flanges are disposed for interengaging when said lower sash is fully lowered.

9. The window of claim 8 wherein said two flanges include an angled ramp portion, angled relative to the direction of movement of said lower sash whereby said interengagement of said two flanges permits progressively tighter interengagement as said lower sash is lowered to its fully lowered position.

10. The window of claim 9 wherein said frame and said sashes are formed of elongate metal extrusions and said fasteners are metal screws.

* * * * *